US008512000B2

(12) United States Patent
Dettmann et al.

(10) Patent No.: US 8,512,000 B2
(45) Date of Patent: Aug. 20, 2013

(54) EXHAUST GAS TURBOCHARGER

(75) Inventors: Tobias Dettmann, Rüterberg (DE); Andre Kaufmann, Tegernheim (DE)

(73) Assignee: Continental Automotive GmbH, Hannover (DE)

( * ) Notice: Subject to any disclaimer, the term of this patent is extended or adjusted under 35 U.S.C. 154(b) by 605 days.

(21) Appl. No.: 12/596,157

(22) PCT Filed: Feb. 27, 2008

(86) PCT No.: PCT/EP2008/052360

§ 371 (c)(1), (2), (4) Date: Oct. 16, 2009

(87) PCT Pub. No.: WO2008/125384

PCT Pub. Date: Oct. 23, 2008

(65) Prior Publication Data

US 2010/0254816 A1 Oct. 7, 2010

(30) Foreign Application Priority Data

Apr. 16, 2007 (DE) ..... 10 2007 017 822

(51) Int. Cl.
*F04D 1/00* (2006.01)

(52) U.S. Cl.
USPC ..... 416/203; 416/223 B

(58) Field of Classification Search
USPC ..... 416/175, 203, 182, 185, 188, 223 B
See application file for complete search history.

(56) References Cited

U.S. PATENT DOCUMENTS

| | | | | | |
|---|---|---|---|---|---|
| 2,484,554 | A * | 10/1949 | Concordia et al. | 416/188 |
| 3,006,603 | A * | 10/1961 | Caruso et al. | 415/195 |
| 4,093,401 | A * | 6/1978 | Gravelle | 416/185 |
| 4,538,963 | A * | 9/1985 | Sugio et al. | 416/203 |
| 4,693,669 | A * | 9/1987 | Rogers, Sr. | 415/143 |
| 4,904,158 | A * | 2/1990 | Kun | 416/183 |
| 5,002,461 | A * | 3/1991 | Young et al. | 416/183 |
| 5,639,217 | A * | 6/1997 | Ohtsuki et al. | 416/183 |
| 6,508,626 | B1 * | 1/2003 | Sakurai et al. | 416/180 |
| 6,663,347 | B2 * | 12/2003 | Decker et al. | 416/185 |
| 7,789,627 | B2 * | 9/2010 | Chiang et al. | 416/144 |
| 2004/0005220 | A1 | 1/2004 | Kawamoto et al. | |
| 2005/0106013 | A1 * | 5/2005 | Ghizawi | 415/204 |
| 2006/0034695 | A1 * | 2/2006 | Hall et al. | 416/213 R |
| 2008/0289332 | A1 * | 11/2008 | Decker et al. | 60/605.1 |
| 2010/0254816 | A1 * | 10/2010 | Dettmann et al. | 416/223 A |

FOREIGN PATENT DOCUMENTS

| | | | |
|---|---|---|---|
| DE | 174855 | C | 8/1905 |
| DE | 345616 | C | 12/1921 |
| DE | 60200911 | T2 | 9/2005 |
| FR | 2550585 | A1 * | 2/1985 |
| GB | 941343 | A | 11/1963 |

* cited by examiner

*Primary Examiner* — Edward Look
*Assistant Examiner* — Christopher R Legendre
(74) *Attorney, Agent, or Firm* — Laurence A. Greenberg; Werner H. Stemer; Ralph E. Locher

(57) ABSTRACT

A turbocharger for or in a motor vehicle has a rotor with an intermediate blade disposed between two primary blades. The intermediate blade, at least in some regions, has an angular progression that differs from the primary blades.

1 Claim, 3 Drawing Sheets

EXHAUST GAS TURBOCHARGER

BACKGROUND OF THE INVENTION

Field of the Invention

In conventional normally aspirated internal combustion engines, a low pressure is generated in the intake tract upon the intake of air, said low pressure increasing with a growing rotational speed of the motor and restricting the theoretically achievable power of the motor. One possibility of counteracting this and therefore achieving improved performance is the use of an exhaust gas turbocharger (EGT). An exhaust gas turbocharger or turbocharger in short is a charging system for an internal combustion engine, by means of which an increased charging pressure is applied to the cylinders of the internal combustion engine.

The detailed setup and functionality is generally known and described for instance in the publication: "Aufladung von PKW DI Ottomotoren mit Abgasturboladern mit variabler Turbinengeometrie" [Charging of automobile DI Otto-engines with exhaust gas turbochargers with variable turbine geometry], September 2006, Peter Schmalz and is thus only described briefly below. A turbocharger consists of an exhaust gas turbine in the exhaust gas flow (exhaust gas path), which is connected to a compressor in the intake tract (inflow path) by way of a common shaft. The turbine is rotated by the exhaust gas flow of the motor and therefore drives the compressor. The compressor increases the pressure in the intake tract of the motor, so that a larger quantity of air reaches the cylinders of the internal combustion engine during the intake stroke as a result of this compression than in the case of a conventional naturally aspirated engine. More oxygen is therefore available for combustion. The increasing medium pressure of the motor noticeably increases the torque and the power output. The supply of a larger quantity of fresh air associated with the compression process on the inlet side is referred to as charging. Since the energy for the charging of the turbine is taken from the rapidly flowing and very hot exhaust gases, the overall degree of efficiency of the internal combustion engine is increased.

High demands are placed on the EGTs. These are above all the high exhaust gas temperatures of up to above 1000° C. and the totally different gas quantities depending on the rotational speed range and the high maximum rotation speed of up to 300,000 revolutions per minute as specified thereby. To improve the range of application of the turbocharger and the responding behavior, so-called intermediate blades (splitter blades) are arranged between the primary blades of a compressor. These have an angular progression which is identical to the primary blades but are however set back compared hereto, i.e. the size of the surface of the intermediate blade is reduced compared to the size of the surface of the primary blade. The use of intermediate blades allows the flow guidance into the blade channels to be improved, particularly in the case of small diameters, and the pressure gradient from the rear of the blades toward the front of the blades to reduce. One exemplary embodiment of a rotor with intermediate blades can be found on page 59 of the publication "Strömungsmaschinen" [Turbomachines], Herbert Siegloch, 3rd Edition, 2006.

The previous embodiments of the intermediate blades are disadvantageous in that different velocity profiles result in the blade channel relative to the leading primary blade compared with the blade channel relative to the lagging primary blade. The losses of efficiency within the turbine thus increase.

BRIEF SUMMARY OF THE INVENTION

It is the object of the present invention to reduce the aforecited disadvantages.

In accordance with the invention, this object is achieved by the turbocharger described herein.

Provision is made accordingly for:

A turbocharger for a motor vehicle, or in a motor vehicle comprising a rotor having an intermediate blade located between two primary blades, in which the intermediate blade, at least in some regions, has an angular progression that differs from the primary blades.

The idea underlying the present invention consists in providing an apparatus in the inflow path or outflow path of an internal combustion engine, with which an incoming gas flow is conveyed as uniformly as possible through a rotor on the compressor and/or turbine side. One advantage of the inventive apparatus is to be able to embody the flow channels on the front face and/or on the rear face of the intermediate blade by means of an angular position of the intermediate blade which deviates from the primary blade such that the loss of efficiency is reduced. The noise development of the turbocharger is also reduced and the range of application of the turbocharger is increased.

Advantageous embodiments and developments of the invention result from the subclaims as well as from the description with an overview of the drawings.

In a typical embodiment of the turbocharger, the angular progression of the intermediate blade is embodied such that the cross-section of the flow channel on the rear of the intermediate blade is essentially identical to the cross-section of the flow channel on the front of the intermediate blade.

In a preferred embodiment, with a predetermined distance from the axis of rotation, the length of the circular arc section from the intermediate blade to the lagging primary blade is less than the length of the circular arc section relative to the leading primary blade.

In an alternative embodiment, the lengths of the circular arc sections from the front and the rear of the intermediate blade to the lagging and leading primary blade are essentially identical at the end of the intermediate blade on the side of the axis of rotation.

In a further configuration, the rotor of the exhaust gas turbocharger is embodied as a turbine wheel (108) or compressor wheel (104).

The invention is described in more detail below with reference to the exemplary embodiments specified in the Figures of the drawing, in which;

DESCRIPTION OF THE INVENTION

Figure 1:
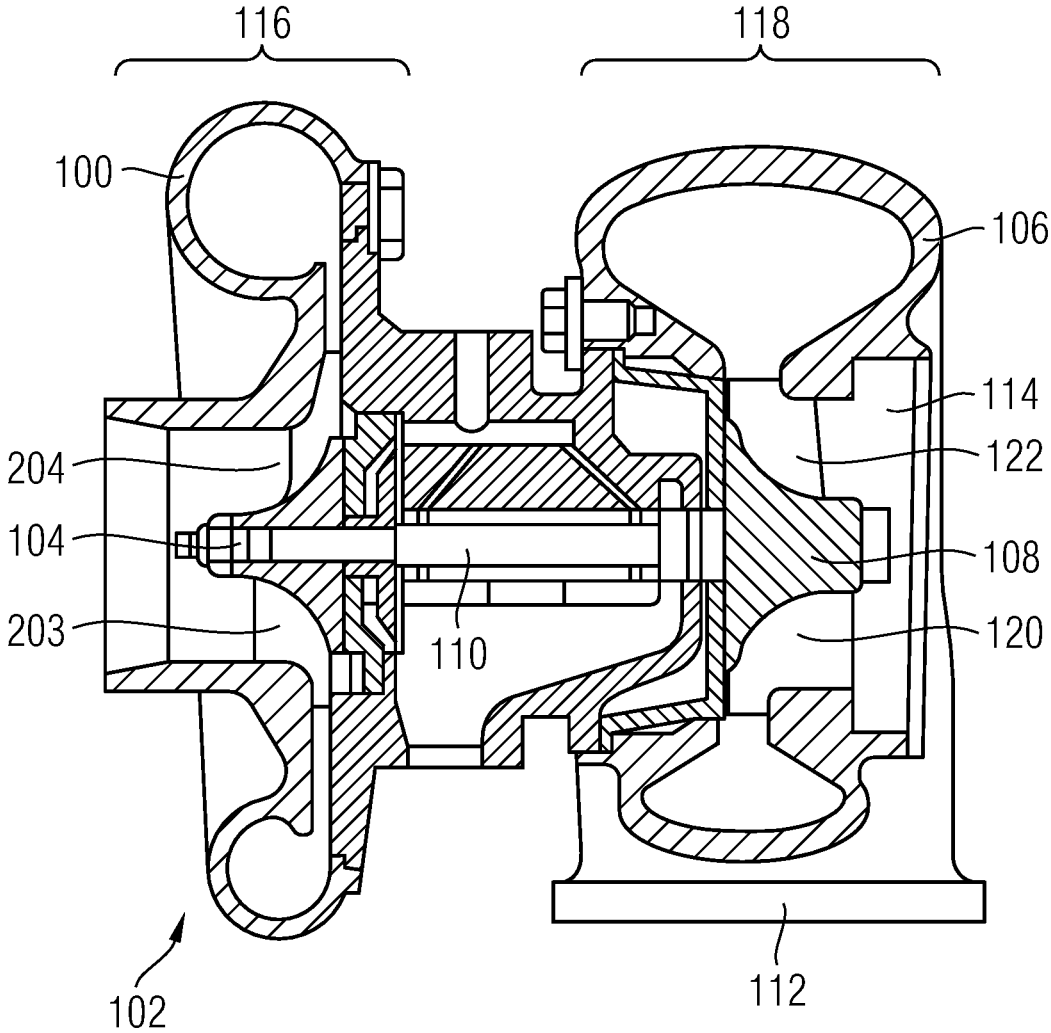
FIG. 1 shows an outline of a turbocharger with an inventive rotor.

Identical and functionally identical elements, features and variables, provided nothing to the contrary is specified, are provided with the same reference characters in the Figures.

FIG. 1 shows an outline of a turbocharger 102 with a turbine 118 and a compressor 116. An inventive turbine wheel 108 is rotatably mounted within a turbine housing 106 of the turbine 118 and is connected to one end of a shaft 110. An inventive compressor wheel 104 is likewise rotatably mounted within the compressor housing 100 of the compressor 116 and is connected to the other end of the shaft 110. The compressor wheel 104 has a primary blade 203 and an intermediate blade 204, the blade surface of which is set back compared with the primary blade. Hot gas is admitted into the turbine by a combustion motor (not shown here) by way of a turbine inlet 112, as a result of which the turbine wheel 118 starts to rotate. The turbine wheel 108 has a primary blade 120 and an intermediate blade 102. The blade edge of the intermediate blade 102 on the outlet side is set back from the edge of the primary blade on the outlet side. The exhaust gas flow leaves the turbine 118 through a turbine outlet 114. The turbine 118 drives the compressor 116 by way of the shaft 110, which couples the turbine wheel 108 to the compressor wheel 104. In the inflow path, the compressor wheel 104 compresses the intake air.

Figure 2:
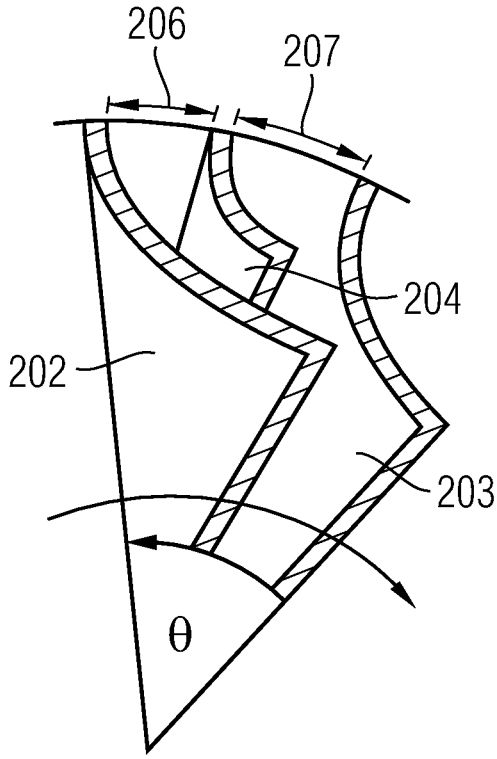
FIG. 2 shows a schematic view onto a blade arrangement on the compressor side.

FIG. 2 shows a schematic view onto an inventive blade arrangement of a compressor wheel for instance with a clockwise direction of rotation, comprising a lagging primary blade 202, an intermediate blade 204 and a leading primary blade 203. The blades are arranged on a section of an axis of rotation at an angle θ, with the counting direction of the angle θ being opposite to the direction of rotation. In accordance with the invention, the length of the circular arc section 206 from the intermediate blade 204 to the lagging primary blade 202 is smaller than the length of the circular arc section 207 between the intermediate blade 204 to the leading primary blade 203. One advantage of the inventive arrangement is that the differences in the lengths of the circular arc sections cause the differences in the surfaces at right angles to the flow guidance to be reduced between the leading and lagging primary blade. Furthermore, the differences in the velocity profiles in the blade channel on the front and rear side of the intermediate blade are also reduced and the degree of efficiency is increased.

Figure 3:
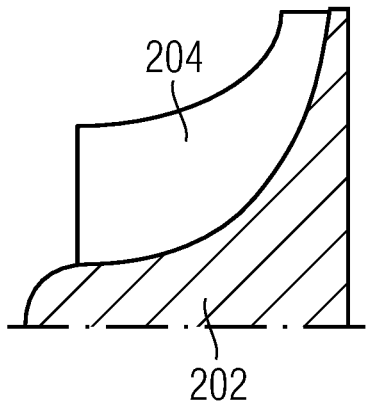
FIG. 3 shows a schematic view of the progression of the meridional coordinates.

FIG. 3 shows a schematic representation of the difference in the progression of the meridional coordinate m' of the intermediate blade 204 and the primary blade 202.

Accordingly, the curvature of the primary blade 202 in the axial direction with a given center distance is different and preferably greater than the curvature of the intermediate blade 204. One advantage of the different curvature is that it is possible, taken together with the different lengths in the circular arc sections, to effectively minimize the differences in the cross-sectional surfaces of the blade channels on the front and rear of an intermediate blade.

Figure 4:
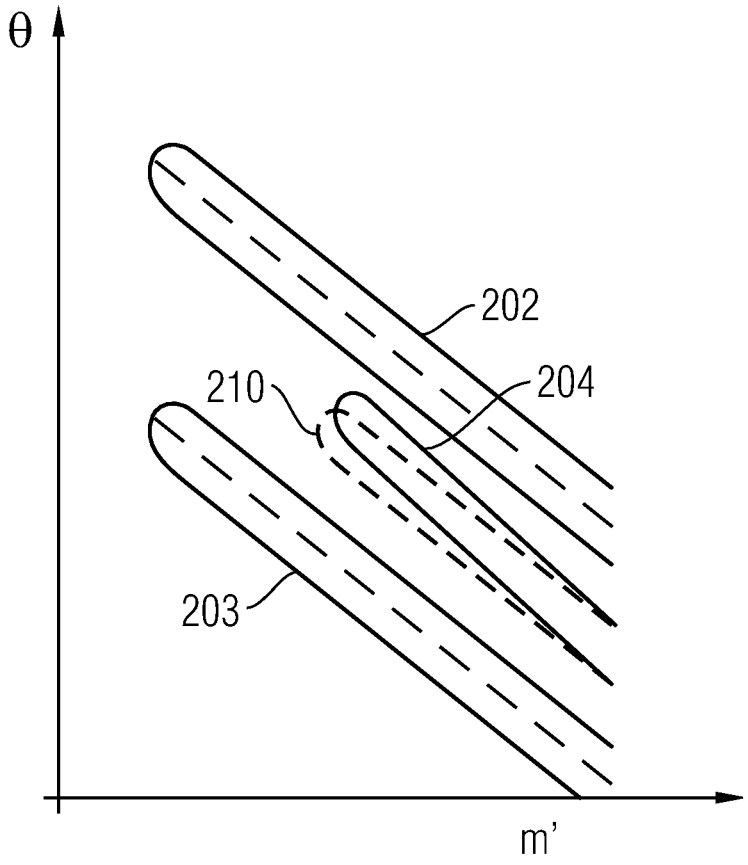
FIG. 4 shows a schematic representation of the axial angle of the blades as a function of a standardized meridional coordinate.

FIG. 4 shows a schematic outline of the axial angle θ as a function of the meridional coordinate m' standardized to the axis of rotation distance. The position of an intermediate blade in accordance with the prior art is reproduced by the dashed line 210.

An intermediate blade with a modified angular progression is shown with the continuous line. The ratio of the flow cross-sections can be thus be adjusted between the preceding and following primary blade.

One advantage of the inventive apparatus is that as a result of the special embodiment, i.e. the different angular arrangement of the intermediate blades both in the axial and also in the radial direction compared with the primary blades, the cross-sections of the flow channels along the front and rear of the intermediate blades can be reliably matched. Aside from increasing the degree of efficiency, the smoothness of the turbocharger is also improved.

The invention claimed is:

1. A turbocharger for or in a motor vehicle, the turbocharger comprising:

a rotor with a plurality of primary blades, wherein in each case an intermediate blade is disposed between two consecutive ones of said primary blades;

said intermediate blade, at least in some regions thereof, having an angular progression different from an angular progression of said primary blades, with the angular progression of said intermediate blade being embodied such that a cross-section of a flow channel on a rear of said intermediate blade is substantially identical with a cross-section of a flow channel on a front of said intermediate blade;

wherein said two consecutive ones of said primary blades include a lagging primary blade and a leading primary blade, and said lagging primary blade has a curvature that is greater than a curvature of said intermediate blade disposed between said lagging primary blade and said leading primary blade;

wherein at a given distance from a rotary axis, a length of a circular arc section from said intermediate blade to said lagging primary blade is less than a length of a circular arc section to said leading primary blade; and wherein, at an end of said intermediate blade on a side of the rotary axis, the lengths of the circular arc sections from the front and the rear of the intermediate blade to said lagging primary blade and to said leading primary blade are substantially identical.

* * * * *